US008381648B2

(12) United States Patent
Ratzloff

(10) Patent No.: US 8,381,648 B2
(45) **Date of Patent: *Feb. 26, 2013**

(54) HINGE STRIPS FOR PRINTER PAPER

(75) Inventor: John Ratzloff, Maple Plain, MN (US)

(73) Assignee: Holmberg Company, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/474,103

(22) Filed: May 17, 2012

(65) Prior Publication Data

US 2012/0224911 A1 Sep. 6, 2012

Related U.S. Application Data

(60) Continuation of application No. 13/304,967, filed on Nov. 28, 2011, now Pat. No. 8,225,717, which is a continuation of application No. 12/640,801, filed on Dec. 17, 2009, now Pat. No. 8,082,843, which is a continuation of application No. 12/245,907, filed on (Continued)

(51) Int. Cl.
*B42F 5/00* (2006.01)

(52) U.S. Cl. ..... 101/483; 40/360; 402/7; 402/79; 402/500

(58) Field of Classification Search ..... None
See application file for complete search history.

(56) References Cited

U.S. PATENT DOCUMENTS

| | | | |
|---|---|---|---|
| 1,023,715 | A | 4/1912 | Bristol |
| 3,014,580 | A | 12/1961 | Brody et al. |
| 4,070,223 | A | 1/1978 | Stalzer |
| 4,127,690 | A | 11/1978 | Schleifenbaum et al. |
| 4,207,366 | A | 6/1980 | Tyler |
| 4,283,871 | A | 8/1981 | Applebaum et al. |
| 4,734,336 | A | 3/1988 | Oliver et al. |
| 4,911,777 | A | 3/1990 | Truc et al. |
| 4,961,666 | A | 10/1990 | Pitts et al. |
| 5,040,216 | A | 8/1991 | Policht |
| 5,248,164 | A | 9/1993 | Lepretre |
| 5,403,138 | A | 4/1995 | Otake et al. |
| 5,407,512 | A | 4/1995 | Policht |
| 5,683,194 | A | 11/1997 | Emmel et al. |
| 5,842,720 | A | 12/1998 | W |

(56)References Citedard

(Continued)

FOREIGN PATENT DOCUMENTS

| | | | |
|---|---|---|---|
| EP | 0266454 | A1 | 5/1988 |
| FR | 2521911 | A1 | 8/1983 |
| GB | 248591 | | 3/1926 |
| GB | 940670 | | 10/1963 |
| JP | 2003-1891 | A | 1/2003 |

OTHER PUBLICATIONS

"Photography and Imaging—Inkjet Media: Classification, nomenclature and dimensions," International Standard ISO 18055-1, ISO Copyright 2004, Ref. No. ISO 18044-1:2004(E); pp. i-v and 1-14.

*Primary Examiner* — Jill Culler
(74) *Attorney, Agent, or Firm* — Seager Tufte & Wickhem LLC

(57) ABSTRACT

The present invention provides a page for binding in an album. The page includes a blank, printer paper sheet and a hinge strip mounted along an edge of the printer paper sheet, the hinge strip including a flexible line for allowing the hinge strip to bend along the flexible line and a portion for binding to an album. The paper sheet and the hinge strip are adapted to go through a printer together to provide a ready-to-bind printed page.

20 Claims, 4 Drawing Sheets

Related U.S. Application Data

Oct. 6, 2008, now Pat. No. 7,654,201, which is a continuation of application No. 10/808,085, filed on Mar. 24, 2004, now Pat. No. 7,437,994, which is a division of application No. 09/991,521, filed on Nov. 20, 2001, now abandoned.

(60) Provisional application No. 60/249,940, filed on Nov. 20, 2000.

(56) References Cited

U.S. PATENT DOCUMENTS

| | | | |
|---|---|---|---|
| 5,941,569 | A | 8/1999 | Solomons |
| 6,071,030 | A | 6/2000 | Hunter et al. |
| 6,309,130 | B1 | 10/2001 | Johnson et al. |
| 6,332,953 | B1 | 12/2001 | Singh et al. |
| 6,449,886 | B1 | 9/2002 | Gray |
| 6,511,246 | B2 | 1/2003 | Sapienza et al. |
| 6,851,718 | B2 | 2/2005 | Liener Chin et al. |

HINGE STRIPS FOR PRINTER PAPER

RELATED APPLICATIONS

This application is a continuation of U.S. application Ser. No. 13/304,967, filed Nov. 28, 2011, which is a continuation U.S. application Ser. No. 12/640,801, filed on Dec. 17, 2009, now U.S. Pat. No. 8,082,843, issued Dec. 27, 2011, which is a continuation of U.S. application Ser. No. 12/245,907, filed on Oct. 6, 2008, now U.S. Pat. No. 7,654,201, issued Feb. 2, 2010, which is a continuation of U.S. application Ser. No. 10/808,085, filed on Mar. 24, 2004, now U.S. Pat. No. 7,437,994, issued Oct. 21, 2008, which is a divisional of U.S. application Ser. No. 09/991,521 filed Nov. 20, 2001 (abandoned), which claims priority under 35 USC119(e) from U.S. Provisional Application Ser. No. 60/249,940, filed Nov. 20, 2000, which applications are incorporated herein by reference and made a part hereof.

FIELD OF THE INVENTION

This invention relates to the field of image archiving, and more specifically to a printable sheet for mounting in an album.

BACKGROUND

Digital ink jet printing of photography is in the early stages of displacing standard photochemical processing and printing. The trend is growing fastest right now within the professional photography market. Inroads into amateur digital photo printing are also rapidly increasing as scanners, printers and computers drop in price and become more powerful. Many of these prints are intended to be placed, exhibited and bound in or on pages of albums and portfolios. It is desirable to keep these quality prints in good condition for as long as possible.

However, photo books and albums now available for these prints have paper and/or plastic pages. The problem with these include bulky storage, stress on the page when it is turned, and weak bindings. Moreover, the plastic materials used, such as polyvinyl chloride, are easily scratched, highly reflective, expensive, and harmful to photo longevity.

SUMMARY

In one embodiment, the present system provides a page for binding in an album. The page includes a blank, printer paper sheet and a hinge strip mounted along an edge of the printer paper sheet. The hinge strip including a flexible portion for allowing the hinge strip to bend and a mounting portion for mounting the page to an album. The paper sheet and the hinge strip are adapted to go through a printer together to provide a ready-to-bind printed page. In one option, the hinge and paper materials meet the highest technical photo and book conservation specifications.

Among other advantages, the present invention provides a system for producing a digital, ready-to-bind photograph in which the image is the page.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
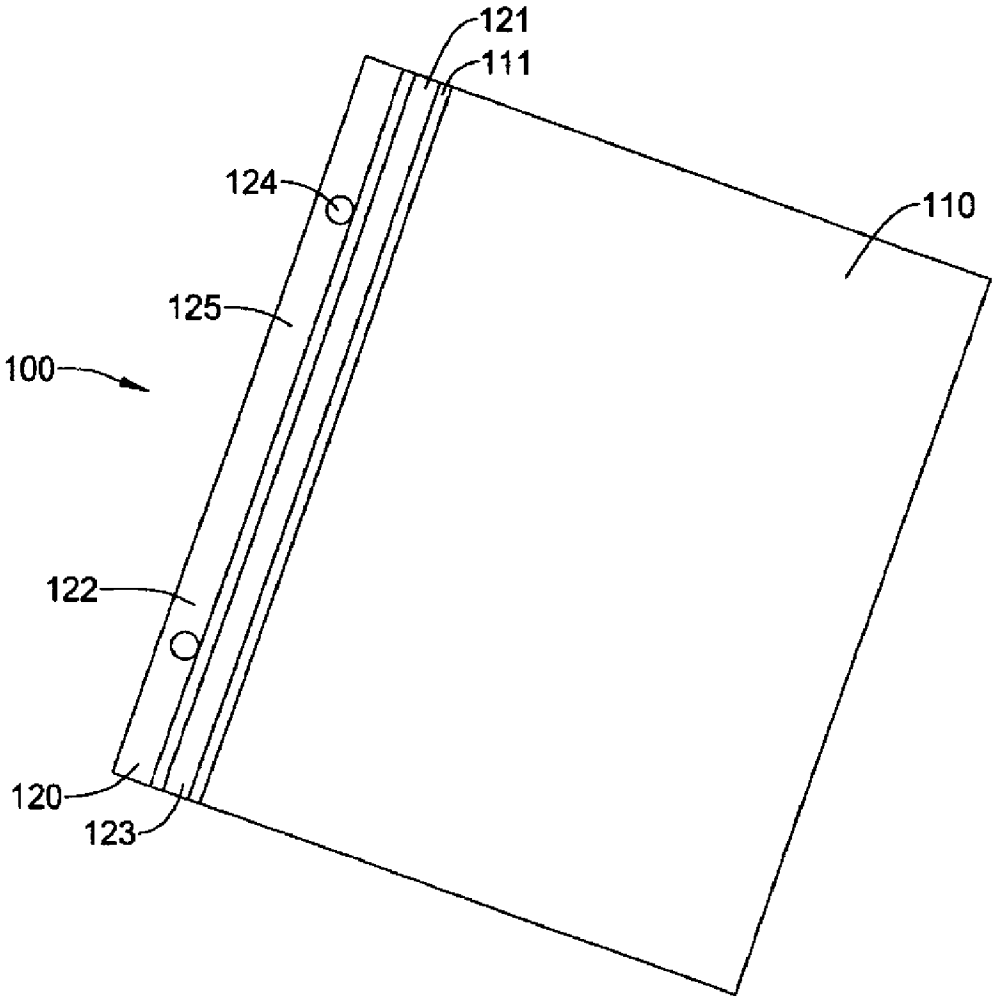
FIG. 1 shows a perspective view of a page in accordance with one embodiment of the present invention.
Figure 2:
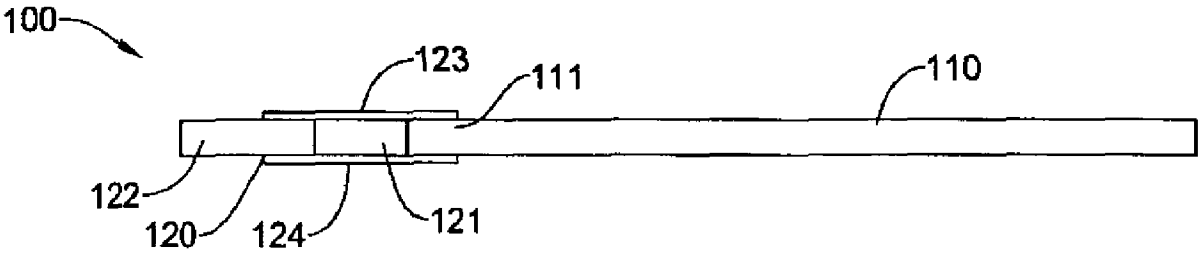
FIG. 2 shows an end view of the page of FIG. 1.

FIG. 1 shows a perspective view of a page 100 in accordance with one embodiment of the present invention. FIG. 2 shows an end view of page 100. Page 100 produces a ready-to-bind print in which the image is the page.

Page 100 includes a blank, printer paper sheet 110 and a hinge strip 120 mounted along an edge 111 of the printer paper sheet.

In one example, sheet 110 is a rectangular sheet of ink jet paper adapted for being printed by a digital ink jet printer. As used herein, blank means that the sheet is adapted for having an image printed thereon. For example, the sheet can have watermarks, a printed border, or other pre-printed design and still be considered blank within the scope of the present system. In one example, sheet 110 includes an uncoated, unbleached, 100% cotton rag. Being uncoated, ink is absorbed into the paper by billions of fine cotton fibers. The image, therefore, becomes integral to the paper. Such a paper provides cotton inkjet prints which are extremely resilient, remaining in good condition even after use and handling. In one example, ADAMANT brand paper is used for sheet 110. ADAMANT brand paper can be ordered from Stone Editions, Inc. (St. Cloud, Minn.). The specifications of ADAMANT brand paper include: 100% cotton rag fiber, 90 lb. weight, cold extract pH: 7.5-8.0 (acid free), buffer: calcium carbonate; reserve: 1.5-1.9% by weight, lignin free, color fast, and no optical brighteners.

Hinge strip 120 is attached along edge 111 of sheet 110 and is designed to serve as a flexible hinge allowing the hinged page 100 to feed through an inkjet printer mechanism while also allowing a printed page 100 to turn flat and lie flat when bound. In one embodiment, hinge strip 120 includes a mounting strip 122 and a pair of flexible connecting strips 123 and 124.

Mounting strip 122 is for mounting or binding page 100 to an album. In this example, mounting strip 122 includes a ¾" wide, 24 point solid bleached acid-free paper strip. Strip 122 has a mounting portion 125 which can be drilled or die cut with two or more ¼" holes 124 to accommodate binding posts and extensions, as a method to bind the page into album covers. In other embodiments, holes 124 can be omitted and the page can be mounted to a C-clamp type binder, for example.

In one example, connecting strips 123 and 124 include ⅞" wide strips of linen or polyofin carrier film (tape) coated with acrylic adhesive. Strips 123 and 124 are applied back to back to edge 111 of sheet 110 and to mounting strip 122. In this embodiment, the connecting strips 123 and 124 are attached so that there is a ⅜" space between sheet 110 and strip 122. In other embodiment, the gap size can vary as necessary. However, a ⅜" gap is conducive to stress-free page turning and pages that turn and lie flat when bound, especially as quantities of pages are added to the binding. The space between sheet 110 and strip 122 defines a flexible portion 121 allowing hinge strip 120 to bend without causing bending in attached sheet 110.

In one example, the polyofin or linen material and acrylic adhesive of hinge 120 combine to yield a totally "archival" binding that will never dry out, yellow, become brittle, crack, or tear. The adhesive is also "reversible" meaning the binding can be intentionally removed from the paper with minimal heat (hair dryer or tacking iron). This quality allows the page to meet strict museum conservation specifications and requirements. Thus allowing a user to make ready-to-print-and-bind album, portfolio and scrapbook pages which meet the highest technical preservation standards (American National Standards Institute and American Society for Testing Materials).

In one example of manufacturing page 100, a page-making machine is provided which incorporates a series of roll unwind stands which provide unwinding and in-line dispensing of roll-fed paper in various widths, two rolls of linen or polyofin acrylic adhesive tape for connecting strips 123 and 124, and a roll of ⅞" wide 20-24 point solid bleached board for mounting strip 122.

The page-making machine unwinds the materials, and aligns the four webs of component materials such that a strip of adhesive is applied onto both the front and the back sides of one edge of the paper and the solid bleached mounting strip to provide a two-sided taping process, whereby the flexible hinge 120 is created and is pressed together through a pinch-roller to create a continuous web style page.

As the final processes, the hinged paper is cut at right angles to the hinge to create single pages 100 of various lengths. The cut-off process is achieved by the use of a guillotine style cut-off blade. Once the hinged-bound page is cut to a specified length, two or more holes are centered and die cut on the ⅞" 20-24 point solid bleached strip. Spacing of the holes is adjustable.

Figure 3:
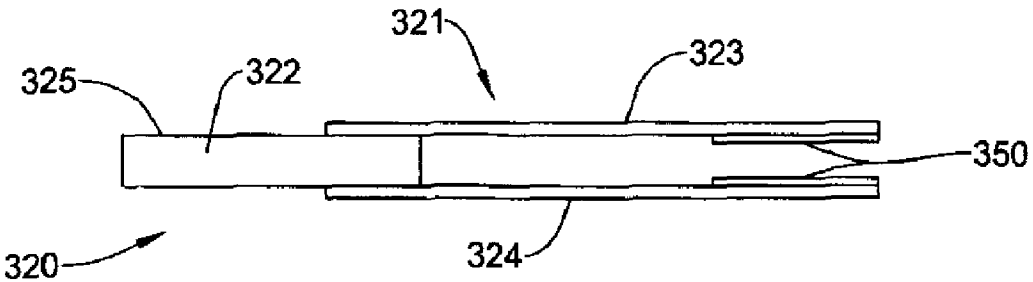
FIG. 3 shows a end view of a hinge strip in accordance with one embodiment.

FIG. 3 shows a end view of a hinge strip 320 in accordance with one embodiment. Hinge strip 320 is an after-market or user applied hinge strip. A user can apply hinge strip 320 either before or after an image is printed on a sheet such as sheet 110.

In this example, hinge strip 320 includes a mounting strip 322 and a pair of connection strips 323 and 324 attached to an edge of strip 322 and overhanging the edge of strip 322. Strip 322 has an album mounting portion 325 and can include mounting holes similar to mounting strip 122 described above. Connection strips 323 and 324 are similar to strips 123 and 124 discussed above and are for mounting to an edge of a printer paper sheet. Each strip 323 and 324 includes an adhesive portion having a release liner 350 covering over the adhesive until a user remove the release liner. A user can apply hinge strip 320 to a sheet of paper such that a flexible line gap 321 is created. Thus, hinge strip 320 includes a flexible portion such that when the hinge strip is mounted to a printer paper sheet the hinge strip is bendable along the flexible line.

Figure 4:
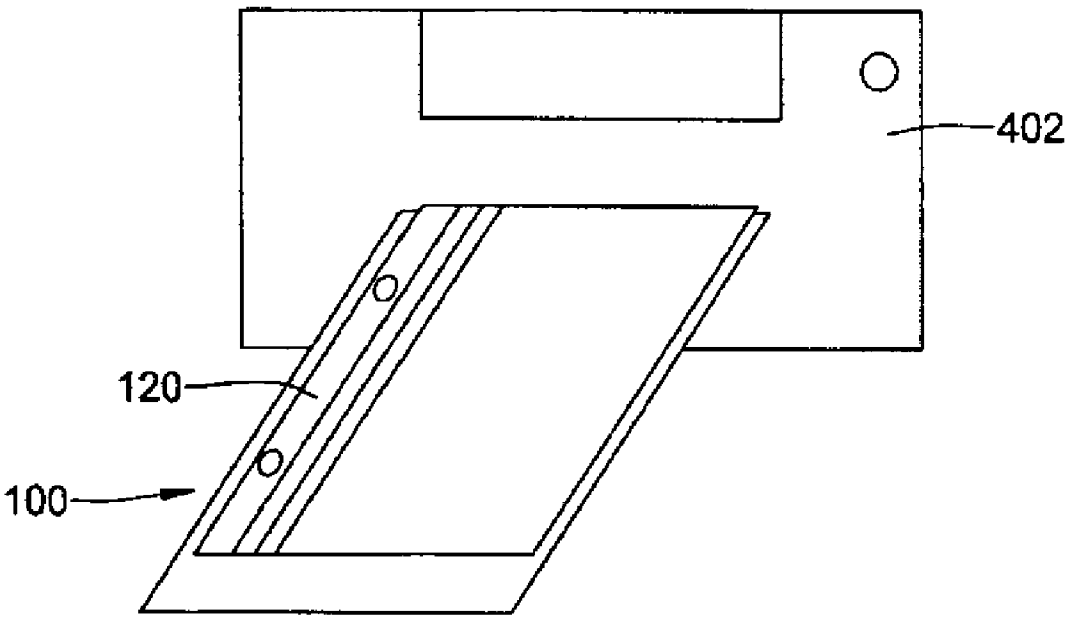
FIG. 4 shows an example use of the page of FIG. 1.

FIG. 4 shows an example use of page 100 on a desktop printer 402. In this example, sheet 110 and hinge strip 120 are attached together and dimensioned to go through a printer together as page 100 to provide a ready-to-bind printed page. In one example, positioning the image on the page is accomplished by setting up a document in a computer imaging computer program to the same dimensions as the pages to be printed and then setting a guide 1½" from the left side of the document. This compensates for the width of the binding and allows proper positioning of the images within the line area of the page.

To print the page, page 100 is placed in printer 402's paper holding tray with hinge strip 120 oriented vertically. The flexible materials of hinge strip 120 do not disrupt the printer's paper feed mechanism during the printing process.

Figure 5:
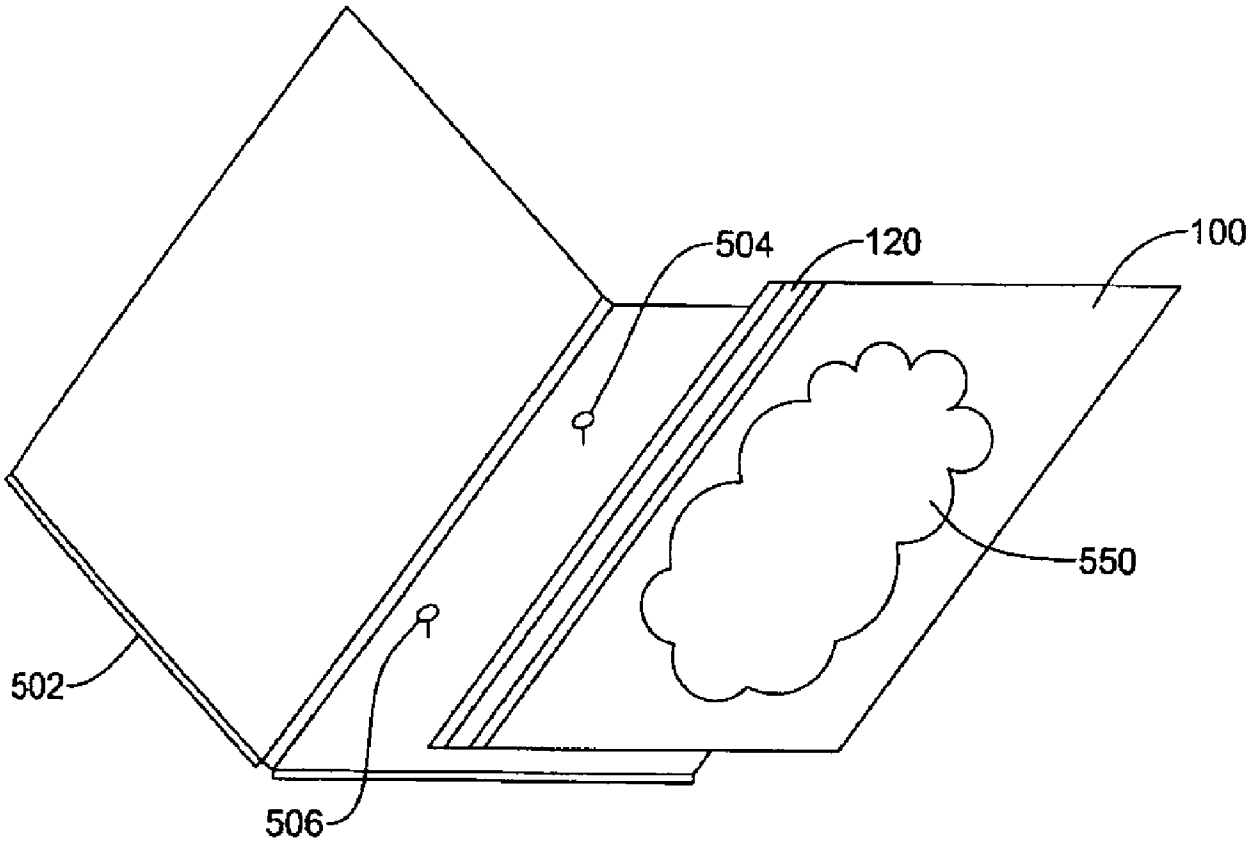
FIG. 5 shows the page of FIG. 1 after it is printed and ready for mounting in an album.

FIG. 5 shows a page 100 after an image 550 is printed and the page is ready for mounting in an album 502. Image 550 can be text, figure, picture digital photo, etc. When bound to posts 504 and 506, pages 100 turn smoothly and lie flat for excellent viewing. In one embodiment, hinge strip 120 is clear, offering no visual clutter to distract from the print. Pages 100 are easily added, removed and rearranged for album 502. Since the pages are the images, no mounting adhesives or expensive, reflective and scratch prone plastic sleeves are necessary.

Accordingly, the present invention improves archivability and preservation of digital ink jet prints by providing top quality paper having a 100% acid free hinge for mounting the paper within an album.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A photo page for mounting in an album, the photo page comprising:

a blank sheet having a thickness; and a hinge strip portion extending along one edge of the blank sheet, the hinge strip portion including a mounting strip of the photo page, the hinge strip portion having a thickness substantially the same as the thickness of the blank sheet;

wherein the photo page is configured to bend along a gap between the mounting strip and the blank sheet without causing bending of the blank sheet;

the photo page further including:

a first connecting strip formed of a flexible polymeric material adhesively attached along a first side of the photo page spanning the gap between the mounting strip and the blank sheet; and a second connecting strip formed of a flexible polymeric material adhesively attached along a second side of the photo page spanning the gap between the mounting strip and the blank sheet;

wherein the blank sheet having the hinge strip portion extending along one edge of the blank sheet is configured to be fed through a printer to print an image thereon.

2. The photo page of claim 1, wherein the second connecting strip is separate from the first connecting strip.

3. The photo page of claim 1, wherein the mounting strip is separate from the blank sheet.

4. The photo page of claim 1, wherein the mounting strip is configured for mounting the photo page in an album.

5. The photo page of claim 1, wherein the mounting strip includes one or more mounting holes.

6. The photo page of claim 1, wherein the gap has a width of about 0.375 inches.

7. The photo page of claim 1, wherein the first connecting strip has an adhesive surface and the second connecting strip has an adhesive surface, the adhesive surface of the first connecting strip facing the adhesive surface of the second connecting strip along the gap.

8. The photo page of claim 1, wherein the mounting strip is configured to be bound into an album.

9. The photo page of claim 1, wherein the hinge strip portion permits the photo page to be laid flat in an album when mounted therein.

10. The photo page of claim 1, wherein the flexible polymeric material of the first connecting strip is polyolefin.

11. The photo page of claim 1, wherein the flexible polymeric material of the second connecting strip is polyolefin.

12. The photo page of claim 1, wherein the photo page is cut from a larger sheet of hinged paper.

13. The photo page of claim 1, wherein the blank sheet has a basis weight of about 90 pounds.

14. A photo page for mounting in an album, the photo page comprising:

a blank sheet having a thickness; and a hinge strip portion extending along one edge of the blank sheet, the hinge strip portion including a mounting strip of the photo page, the hinge strip portion having a thickness substantially the same as the thickness of the blank sheet;

wherein the photo page is configured to bend along a gap between the mounting strip and the blank sheet without causing bending of the blank sheet;

the photo page further including:

a first connecting strip formed of a flexible material adhesively attached along a first side of the photo page spanning the gap between the mounting strip and the blank sheet; and a second connecting strip formed of a flexible material adhesively attached along a second side of the photo page spanning the gap between the mounting strip and the blank sheet;

wherein the blank sheet having the hinge strip portion extending along one edge of the blank sheet is configured to be fed through a printer to print an image thereon.

15. The photo page of claim 14, wherein the second connecting strip is separate from the first connecting strip.

16. The photo page of claim 15, wherein the first connecting strip has an adhesive surface and the second connecting strip has an adhesive surface, the adhesive surface of the first connecting strip facing the adhesive surface of the second connecting strip along the gap.

17. The photo page of claim 16, wherein the mounting strip is separate from the blank sheet.

18. The photo page of claim 16, wherein the hinge strip portion permits the photo page to be laid flat in an album when mounted therein.

19. The photo page of claim 18, wherein the photo page is cut from a larger sheet of hinged paper.

20. The photo page of claim 19, wherein the blank sheet has a basis weight of about 90 pounds.

* * * * *